US005882079A

United States Patent [19]

Yang

[11] Patent Number: 5,882,079

[45] Date of Patent: Mar. 16, 1999

[54] STRUCTURE OF BACK CUSHION FOR LEISURE

[75] Inventor: Ming-Shun Yang, Taipei, Taiwan

[73] Assignee: Formosa Saint Jose Corp., Pan-Chiao, Taiwan

[21] Appl. No.: 589,874

[22] Filed: Jan. 23, 1996

[51] Int. Cl.[6] ..... A47C 27/00; A47C 20/04

[52] U.S. Cl. ..... 297/377; 5/419; 5/634; 297/228.1

[58] Field of Search ..... 5/634, 633, 419; 297/377, 228.1

[56] References Cited

U.S. PATENT DOCUMENTS

| | | | |
|---|---|---|---|
| 2,368,498 | 1/1945 | Sturgeon | 297/377 |
| 3,342,294 | 9/1967 | Beatty | 297/377 |
| 4,945,587 | 8/1990 | Ferro | 5/419 |
| 5,503,455 | 4/1996 | Yang | 297/377 |

FOREIGN PATENT DOCUMENTS

| | | | |
|---|---|---|---|
| 1044254 | 1/1953 | France | 297/377 |
| 1167623 | 11/1958 | France | 297/377 |

*Primary Examiner*—Alexander Grosz
*Attorney, Agent, or Firm*—Erik M. Arnhem

[57] ABSTRACT

An adjustable backrest is reinforced by a fixed frame that fits snugly into upper and lower bags affixed to the rear surface of the backrest cushion. One of the bags has a zipper assembly that can be operated to open the bag for easy insertion of the frame into the bag. A swingable support frame is hingedly connected to the fixed frame to support the backrest cushion at various different slant angles.

6 Claims, 5 Drawing Sheets

STRUCTURE OF BACK CUSHION FOR LEISURE

BACKGROUND AND SUMMARY OF THE INVENTION

This invention relates to an adjustable backrest usable by a person who assumes a reclining position resting his head and back against the backrest. The backrest preferably comprises a soft air-inflated cushion or padded cushion supported in an inclined position whereby a person can rest his head and back on the cushion while reading a newspaper, watching the television, or taking a nap. An aim of the invention is to provide a comfortable back support that has an adjustable inclination angle, to eliminate pain or discomfort, e.g. lumbago, back pain, head soreness, or neck pain.

In a preferred form of the invention, the backrest comprises: a soft cushion having a lower edge and an upper edge, and a fixed frame spanning essentially the entire rear surface of the cushion. The frame fits within upper and lower bags affixed to the cushion rear surface, whereby the frame acts, as a stiffener that prevents the cushion from flexing, bending or slipping. A movable support frame is hingedly connected to the fixed frame for swinging motion around the hinge axis, to adjust the slant angle of the cushion. A flexible cable means is trained between the fixed frame and an adjustable anchorage on the movable frame, whereby the cable means supports the frames against collapse while permitting a desired adjustment or setting of the inclination angle between the two frames.

Further features and advantages of the invention will be apparent from the attached drawings and description of an illustrative embodiment of the invention.

THE DRAWINGS

DESCRIPTION OF A PREFERRED EMBODIMENT OF THE INVENTION

Figure 1:
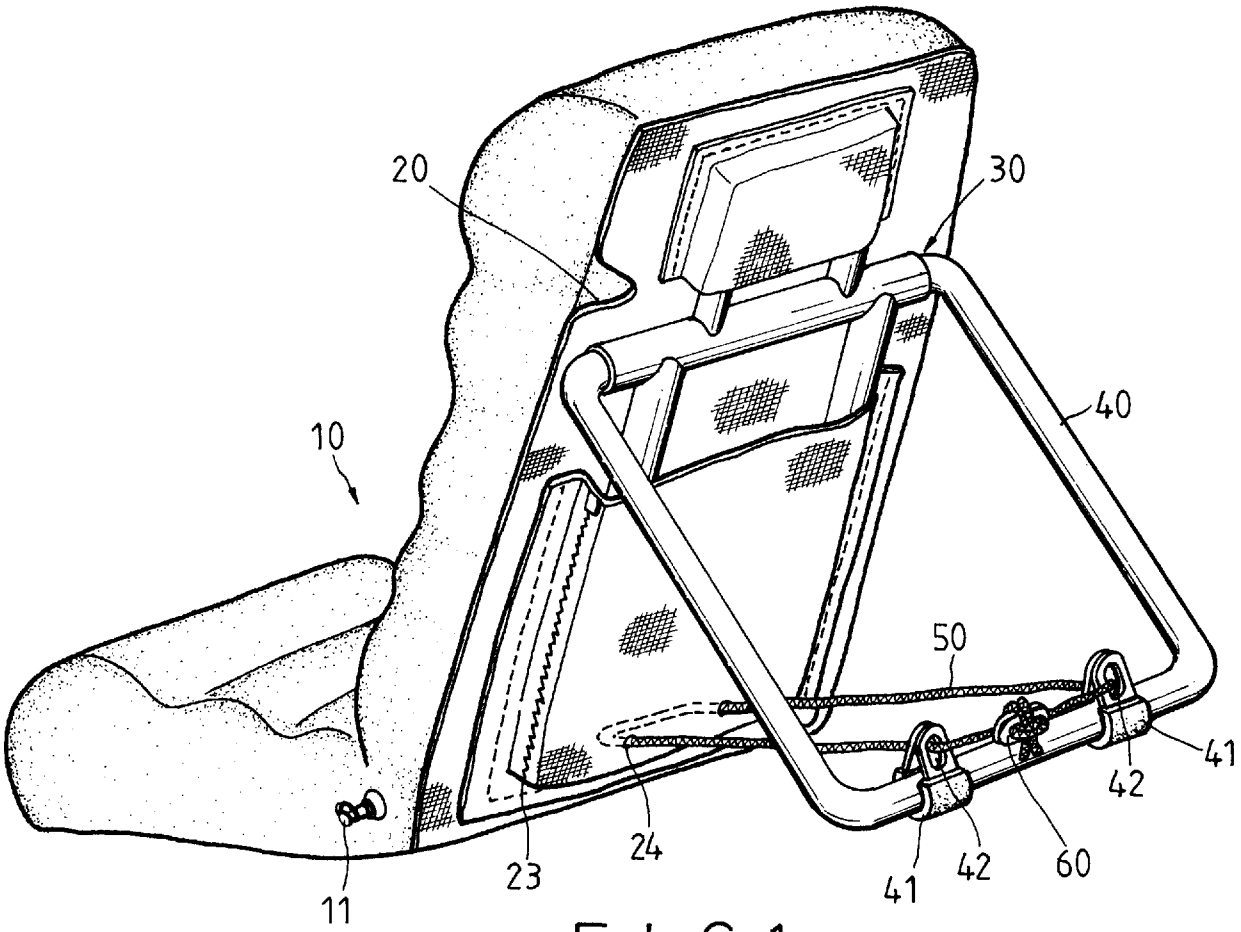
FIG. 1 is a rear perspective view of a backrest constructed according to the invention.
Figure 2:
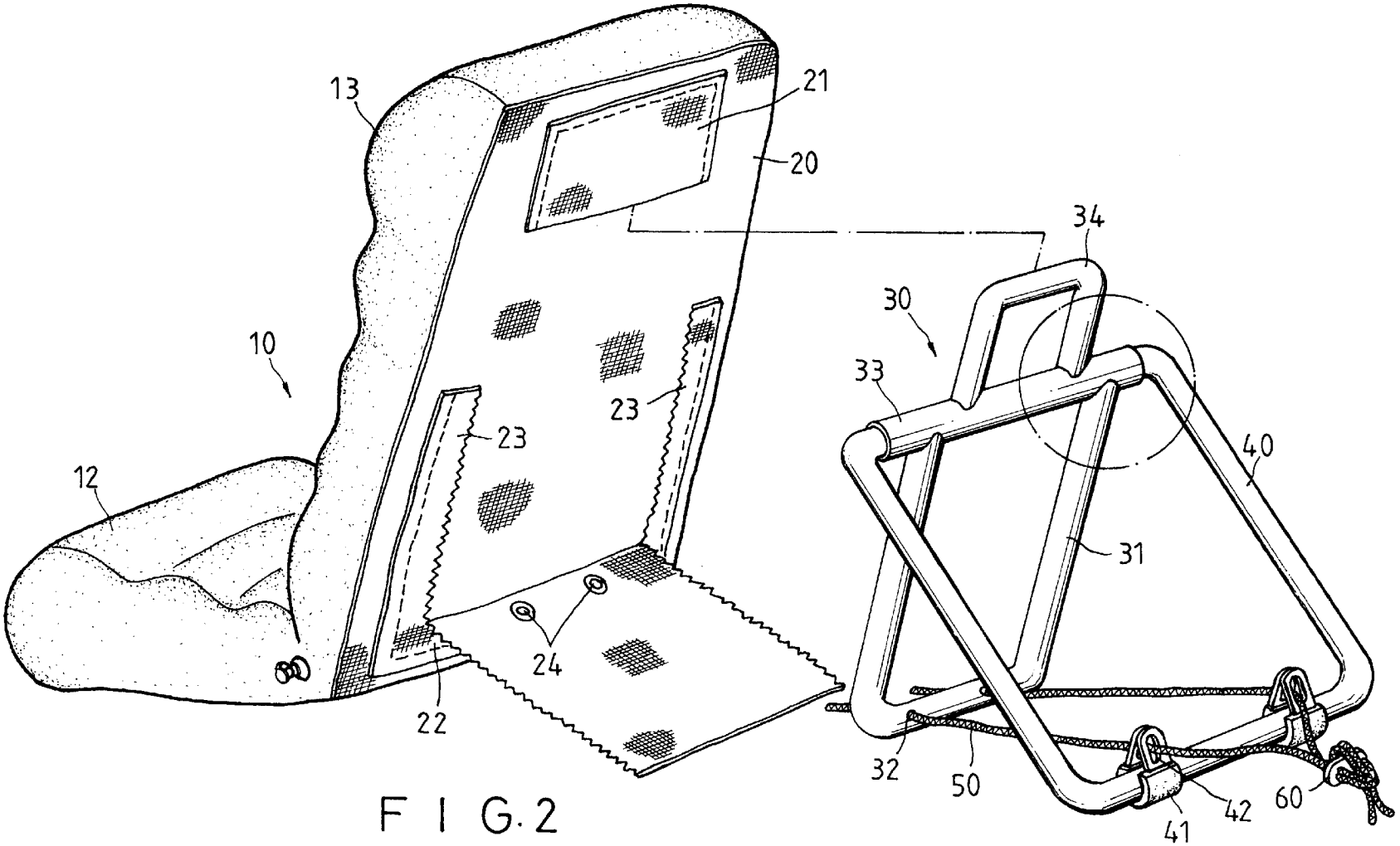
FIG. 2 is an exploded view of the backrest depicted in FIG. 1.
Figure 6:
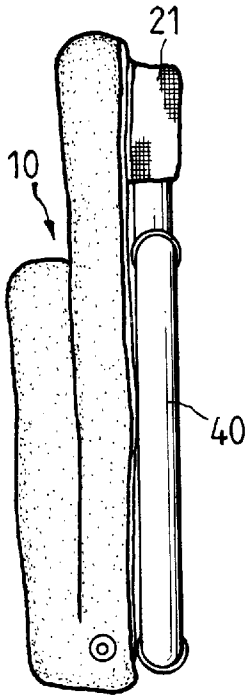
FIG. 6 is a view taken in the same direction as FIG. 4, but showing the backrest in a folded condition suitable for shipment or storage.

Referring to FIGS. 1 and 2, there is shown an adjustable human body support 10 that includes a seat 12 and backrest 13 extending angularly upwardly from the seat. The seat and backrest are formed as a unitary hollow flexible air-inflatable pillow equipped with an air-inflation nozzle 11, whereby the body support 10 provides relatively soft comfortable body-engagement surfaces.

A flexible panel 20, attached to the rear surface of backrest cushion 13, forms an attachment surface for an upper bag 21 and a lower bag 22. Upper bag 21 has a downwardly open mouth adapted to receive an upper section

Figure 3:
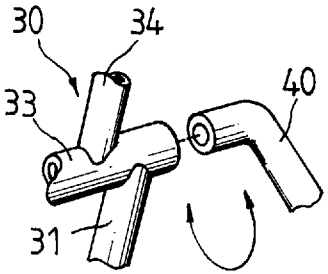
FIG. 3 is an exploded view of a hinge structure circled in FIG. 2 of the drawings.

34 of a fixed frame 30. Lower bag 22 has an upwardly open mouth adapted to receive a lower section 31 of the fixed frame 30. As will be apparent from FIG. 3, frame 30 is formed of tubular frame elements suitably connected together, to provide a generally rectangular frame structure having curved (arcuate) corners adapted to fit readily within bags 21 and 22.

As can be seen from FIG. 1, the upper and lower sections of frame 30 are sized to have a snug fit within bags 21 and 22, whereby the fixed frame rigidifies the backrest cushion 13 against flexure or bending. Bags 21 and 22 collectively encircle frame 30 to prevent the backrest cushion from slipping downwardly on the frame.

Figure 4:
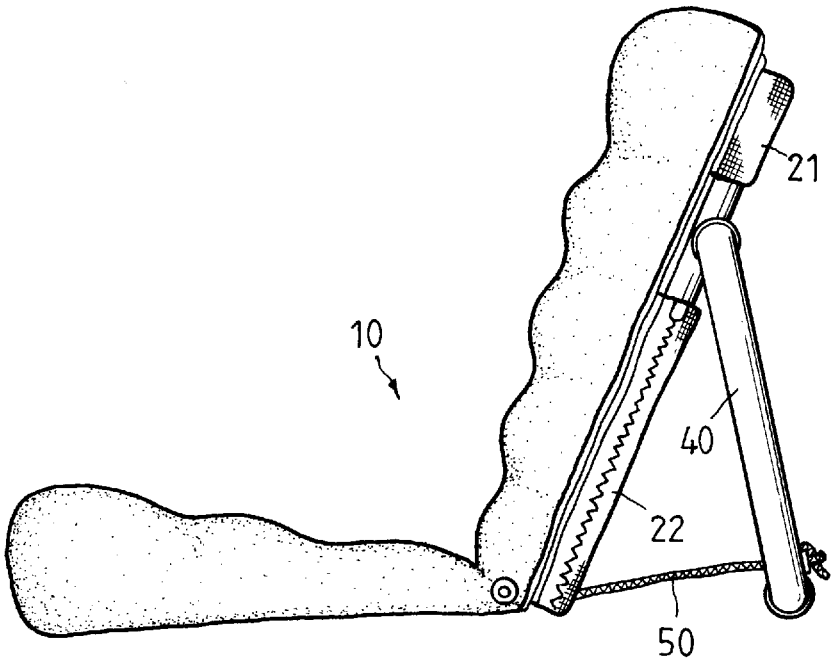
FIG. 4 is a side elevational view of the FIG. 1 backrest.
Figure 5:
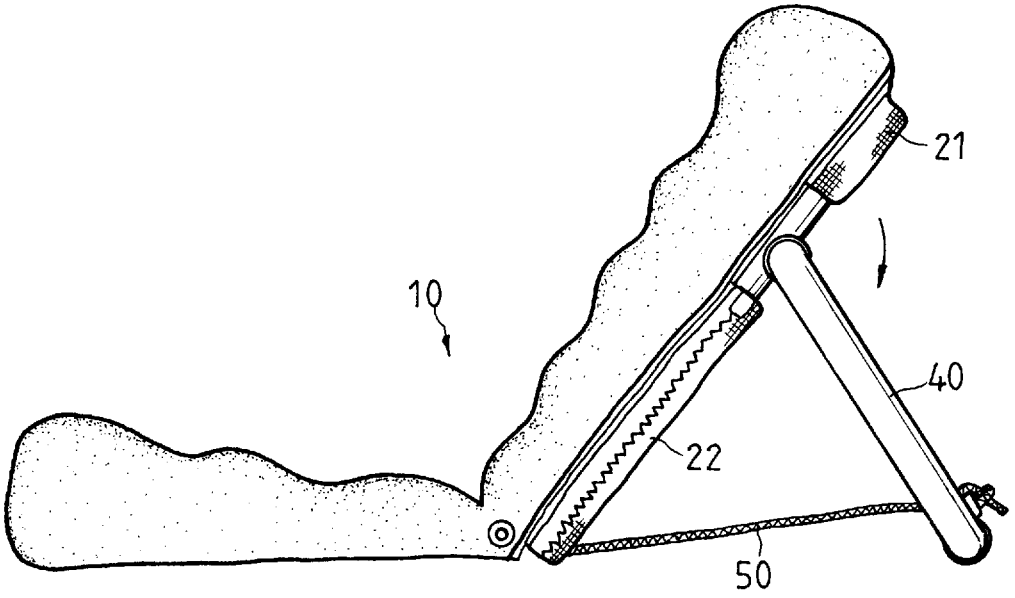
FIG. 5 is a view taken in the same direction as FIG. 4, but with the cushion in a different slant angle.

A generally rectangular movable frame 40 has two in-twined tubular ears that telescope into the ends of a hollow tubular shaft 33 that forms part of the fixed frame 30, whereby frame 40 can swing (.or hinge) around the shaft 33 axis. The hinging motion of frame 40 can be used to adjust the slant angle of backrest cushion 13. FIGS. 4 and 5 show two different slant angles that the backrest cushion can take.

Lower bag 22 has two generally parallel zippers 23, 23 extending along the bag 22 side edges between the bag's lower edge and upper mouth, whereby the bag major wall can be drawn downwardly away from panel 20 to the bag-open position depicted in FIG. 2. This operation permits frame 30 to be inserted into bags 21 and 22, as a snug form fit (:when zippers. 23, 23 are closed to the FIG. 1 condition).

Frames 30 and 40 are supported against undesired collapse by means of a flexible cable 50 that extends through holes: 32 in frame 30 and aligned holes 42 in pads 41 on frame 40. The free ends of cable 50 extend through a clamp (or clip) 60 that can be slidably adjusted along the cable sections to vary the effective length of the cable. By moving the cable sections through clamp 60 it is possible to adjust (or vary) the angulation angle between frames 30 and 40 (as shown e.g. in FIGS. 4 and 5). Clearance holes 24 are formed in the major wall of bag 22 to accommodate cable 50 (when the bag is in the FIG. 1 closed condition). The cable is threaded through holes 24 while the major wall of bag 22 is in the FIG. 2 open condition.

Figure 7:
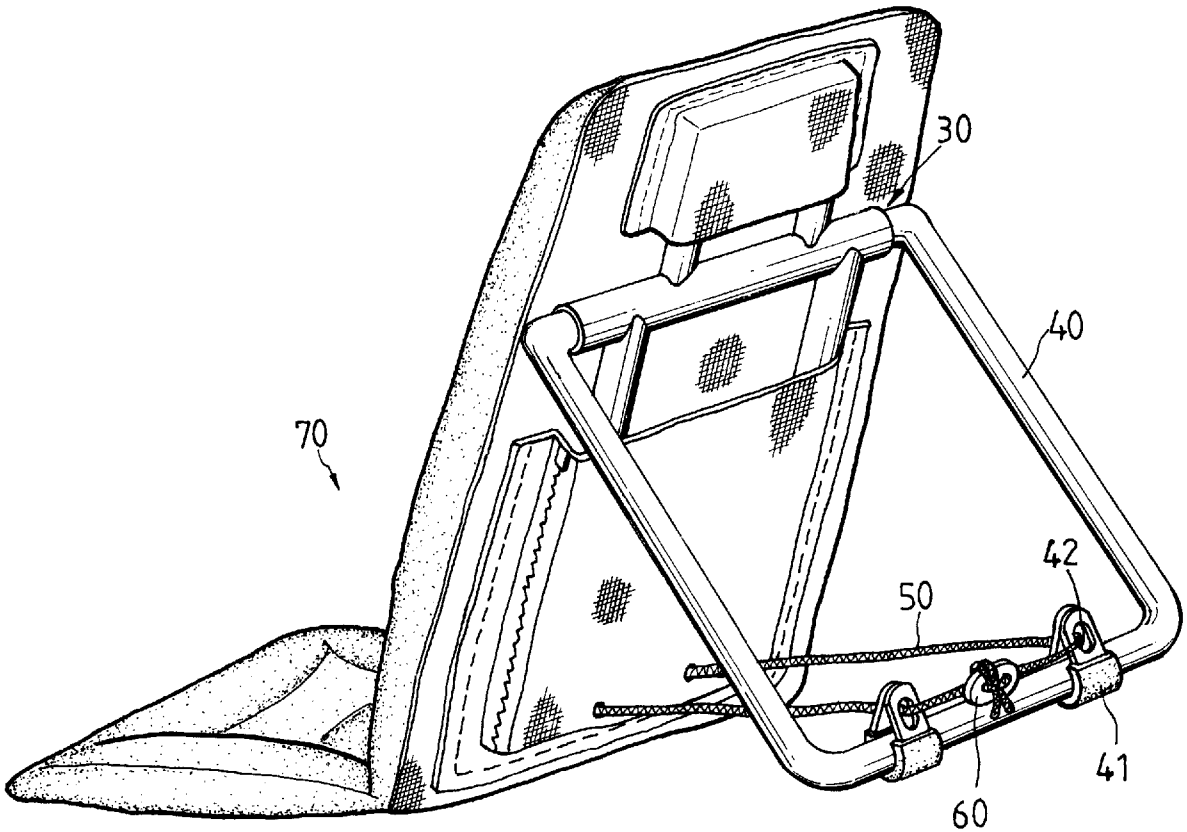
FIG. 7 is a perspective view taken in the same direction as FIG. 1, but showing another form that the invention can take.

FIG. 7 shows a second form of the invention that is identical with the FIG. 1 construction, except that the seat and back cushions are formed out of a padded flannel material. In FIG. 7 the seat-backrest cushion assembly is referenced generally by numeral 70.

It will be appreciated that some variation in structure and arrangement can be utilized while still practicing the invention. The drawings show illustrative forms of the invention.

I claim:

1. An adjustable backrest comprising a yieldable back support cushion having an upper edge, lower edge and rear surface;

an upper bag on the cushion rear surface proximate to the cushion upper edge; said upper bag having a downwardly open mouth;

a lower bag on the cushion rear surface proximate to the cushion lower edge; said lower bag having an upwardly open mouth;

a fixed frame having an upper section thereof inserted into the upper bag, and a lower section thereof inserted into the lower bag;

a movable support frame hingedly connected to said fixed frame for swinging motion around a horizontal axis, to adjust the slant angle of the back support cushion; and flexible cable means trained between the fixed frame and movable frame to prevent frame collapse; said cable means having an adjustable anchorage on the movable frame to vary the angulation of the two frames.

2. The adjustable backrest of claim 1, wherein said back support cushion comprises an air-inflatable pillow having a flexible panel (20) attached to its rear surface; said upper and lower bags being affixed to said flexible panel.

3. The adjustable backrest of claim 1, wherein said lower bag has a lower edge extending along the cushion lower edge, said lower bag further comprising two side edges extending upwardly between its lower edge and the bag mouth; said lower bag further comprising zipper means paralleling the bag side edges, whereby said lower bag can be opened to permit the fixed frame to be inserted into said lower bag.

4. The adjustable backrest of claim 3, wherein said zipper means comprises two separate zippers extending along the respective bag side edges.

5. The adjustable backrest of claim 1, wherein each bag has a rectangular plan configuration.

6. The adjustable backrest of claim 1, wherein each bag is sized to have a snug form fit on a section of the fixed frame, whereby said fixed frame rigidifies the cushion against flexure or bending.

* * * * *